US005847747A

United States Patent [19]

Ishikawa

[11] Patent Number: 5,847,747

[45] Date of Patent: Dec. 8, 1998

[54] TRACTOR UNIT

[75] Inventor: Yutaka Ishikawa, Tokyo, Japan

[73] Assignee: Asahi Kogaku Kogyo Kabushiki Kaisha, Tokyo, Japan

[21] Appl. No.: 903,005

[22] Filed: Jul. 30, 1997

[30] Foreign Application Priority Data

Aug. 1, 1996 [JP] Japan ..... 8-219432

[51] Int. Cl.[6] ..... B41J 11/26

[52] U.S. Cl. ..... 347/262; 400/616.1

[58] Field of Search ..... 347/245, 262, 347/263; 400/616.1

[56] References Cited

U.S. PATENT DOCUMENTS 5,105,227 4/1992 Kitamura et al. ..... 399/317

5,212,531 5/1993 Monma et al. ..... 399/16

5,515,149 5/1996 Ishikawa et al. ..... 399/384

5,516,220 5/1996 Ishikawa et al. ..... 400/616.1

*Primary Examiner*—Nancy Le

*Assistant Examiner*—Hai C. Pham

*Attorney, Agent, or Firm*—Greenblum & Bernstein, P.L.C.

[57] ABSTRACT

A tractor unit for a recording sheet is provided. A tractor belt is provided with protrusions for engaging with feed holes formed on both sides of the recording sheet. A pulley rotates the tractor belt and a frame supports the pulley. The recording sheet is fed in a predetermined direction by rotation of the pulley. The frame has a top sensor for sensing passage of a leading edge of recording sheet and for outputting a predetermined signal. A cover member covers the recording sheet such that the recording sheet does not warp or float up from the tractor belt.

14 Claims, 4 Drawing Sheets

TRACTOR UNIT

BACKGROUND OF THE INVENTION

The present invention relates to a tractor unit for feeding a recording sheet.

A tractor unit is used in a continuous form printer or the like, for feeding a recording sheet. The tractor unit includes a pair of tractor belts and pulleys for rotating the tractor belts. The tractor belt has protrusions for engaging with feed holes formed at a predetermined pitch on both sides of recording sheet.

In order to detect a leading edge of the recording sheet after the recording sheet is set in the tractor unit, a top sensor is provided on the downstream side of the tractor unit in the feeding direction of the recording sheet. The top sensor includes a swinging lever swingable between an erect position, where the swinging lever projects across a feeding path of the recording sheet, and a retracted position where the swinging lever does not interfere with the feeding path. When a recording sheet is present at the position of the swinging lever, the swinging lever is pressed down by the recording sheet below the feeding path. The top sensor further includes a detecting sensor for detecting the position of the swinging lever. In general, the detecting sensor is arranged to generate an OFF signal when the swinging lever is in the erect position and to generate an ON signal when the swinging lever is in the retracted position.

In order to allow the feeding of various widths of recording sheet, the tractor unit is so constructed that the distance between the two tractor belts can be adjusted according to the width of the recording sheet. Thus, the tractor belts are mounted on two movable frames which are movable toward and away from each other, so that the distance between the tractor belts can be adjusted. The center of the movement of the movable frames corresponds to the center of the width of the recording sheet.

Conventionally, the top sensor is provided to a stationary member of the tractor unit located at the center of both movable frames, so that the top sensor can detect the leading edge of the recording sheet irrespective of the width of the recording sheet, and so that the existence of the top sensor does riot interfere the passage of the recording sheet.

However, there is a possibility that the recording sheet may be warped, causing a portion of the recording sheet to be deflected upward. In-this case, if the portion of the recording sheet deflected upward is above the swinging lever, the swinging lever may not be pressed down by the recording sheet even though the recording sheet is in position. consequently, a controller (which controls the tractor unit) may mistakenly determine a leading edge of the recording sheet as coming after the actual leading edge, which causes a deviation of the printing position on the recording sheet.

More particularly, a recently developed printer is arranged to discharge a printed page of the recording sheet out of the printer so that a user may. check the result of the printing or may separate the page. In such a printer, since a user touches the discharged sheet for checking, the chance of the recording sheet being warped and deflected is increased. Thus, the above-mentioned incorrect detection of the leading edge may occur more often.

SUMMARY OF THE INVENTION

It is therefore an object of the present invention to provide a tractor unit in which an incorrect detection of the leading edge of the recording sheet can be prevented.

According to an aspect of the present invention, there is provided a tractor unit including a pair of tractor belts each having protrusions engaging with feed holes formed on both sides of recording sheet. A pair of frames each support a respective tractor member. A top sensor provided to one of the frames detects the passage of a leading edge of the recording sheet. At least one cover member provided to the one of the frames holds the recording sheet to the tractor belt.

With such an arrangement, since the top sensor is provided to the frame and the recording sheet is covered by the cover member provided on the frame, a portion (of the recording sheet) positioned above the top sensor is hardly deformed even when the recording sheet is warped. Thus, the mistaken recognition of the leading edge of the recording sheet can be prevented. Further, since the top sensor is integrally mounted on the frame, the number of parts is decreased. By providing the top sensor at a portion (of the frame) beneath the recording sheet feeding path, the existence of the top sensor does not interfere the passage of the recording sheet.

Preferably, the top sensor may be provided on the downstream side of the cover member in the direction of the feeding of the recording sheet. It is possible that each of the frames is provided with the cover member holding the recording sheet to the tractor belt.

Further, it is preferable to provide two sets of pulley which drive the pair of tractor belts. The pulleys are supported by the frames.

In a particular arrangement, the top sensor includes a swinging lever swingable between a erected position where the lever projects across a feeding path of the recording sheet and a retracted position where. the lever retracts from the erected position in which the lever falls down from the standing-up position, and a sensor detecting which position the swinging lever is in.

Conveniently, the frames are movable toward and away from each other so that the distance between two tractor belts can be adjusted. With this, it is possible to adjust the distance of two tractor belt according to the width of the recording sheet by moving the frames. Further, even if the frames are moved, the top sensor is in a position where it is possible to detect the leading edge of the recording sheet.

DESCRIPTION OF THE PREFERRED EMBODIMENTS

Figure 1:
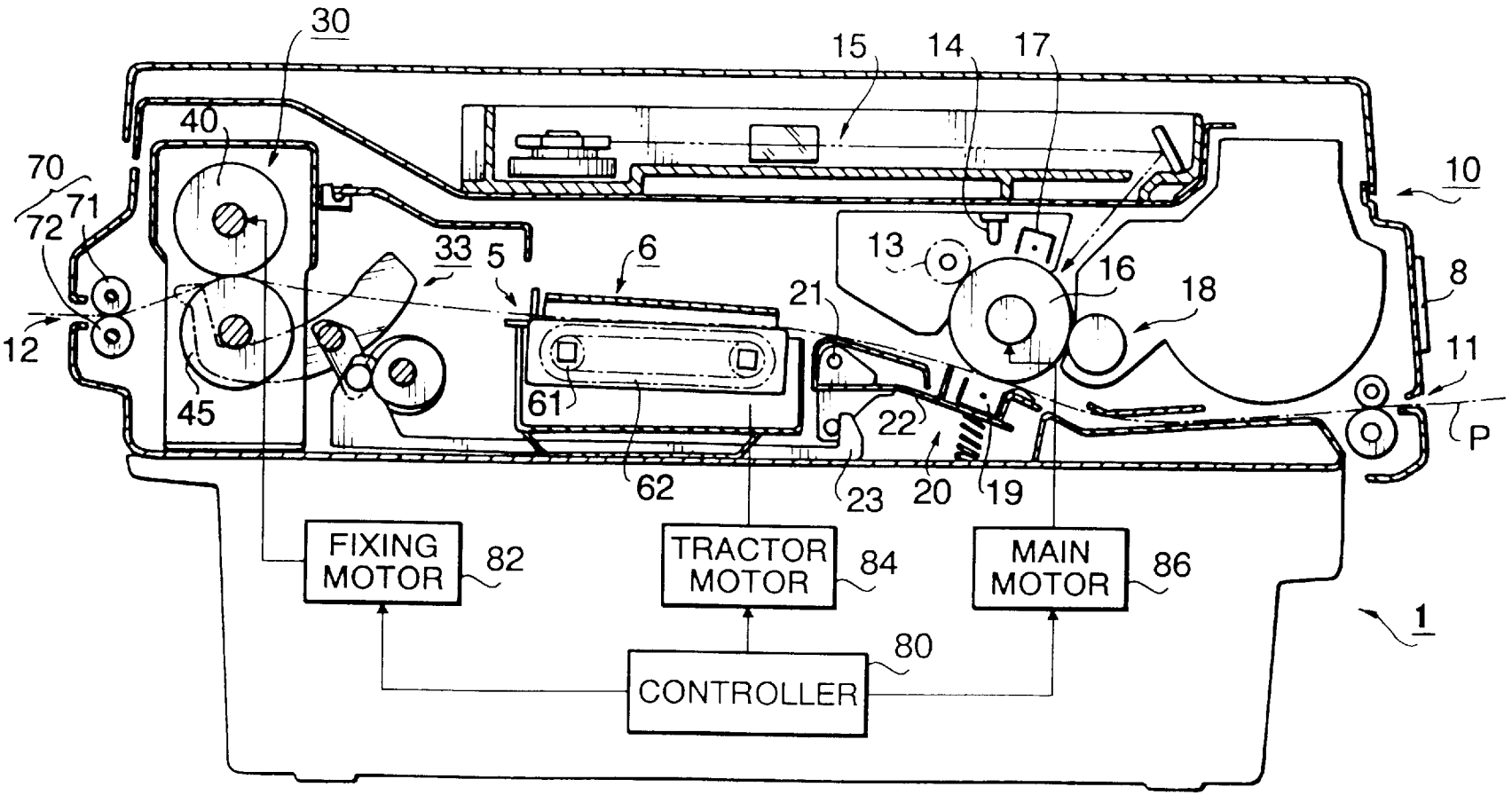
FIG. 1 is a side view of a printer according to an embodiment of the invention.

An embodiment of the present invention is described with reference to the accompanying drawings. FIG. 1 shows a continuous form printer 1 arranged to print images on a continuous recording sheet P using so-called electrophotographic technology.

The printer 1 includes a laser scanning unit 15 for emitting a laser beam, a photoconductive drum 16 on which a latent image is formed by the laser beam emitted from the laser scanning unit 15, a developing unit 18 for applying toner to the latent image formed on the photoconductive drum 16, a transfer unit 20 for transferring a toner image from the photoconductive drum 16 onto a recording sheet P, and a fixing unit 30 for fixing the toner image on the recording sheet P. All of these are accommodated in a housing 10.

The printer 1 further includes a cleaning unit 13 for removing residual toner on the photoconductive drum 16 and a discharge unit 14 for discharging the surface of the photoconductive drum 16 and a charging unit 17 for uniformly charging the surface of the photoconductive drum 16.

The recording sheet P enters into the housing 10 from a sheet inlet 11 provided at one side of the.housing 10. In the housing 10, the recording sheet P passes through the above-described transfer unit 20 and fixing unit 30 along a predetermined feeding path. Then, the recording sheet P is discharged from a sheet outlet 12. provided at the other side of the housing 10. A feeding of the recording sheet P in the housing 10 is performed by a tractor unit 6 provided between the transfer unit 20 and the fixing unit 30. A discharge roller unit 70, for discharging the recording sheet P, is provided between the fixing unit 30 and the sheet outlet 12.

A printing process is performed as follows. A laser beam is emitted from the laser scanning unit 15. The surface of the photoconductive drum 16 is exposed by this laser beam. The surface of the photoconductive drum 16 is uniformly charged by a charging unit 17 and is exposed by the above-described laser beam so as to form a latent image. The developing unit 18 applies toner to the latent image thus formed on the photoconductive drum 16. A toner image is thus formed on the photosensitive surface of the photoconductive drum 16 and is transferred onto the recording sheet P at a corona charger 19 provided in the transfer unit 20. The toner image transferred onto the recording sheet P is fixed on the recording sheet P by the fixing unit 30 under a given pressure and heat. Residual toner remaining on the surface of the photoconductive drum 16 is removed by the cleaning unit 13. Further, the surface of the photoconductive drum 16 is discharged by the -discharge unit 14 for the next printing process. A controller 60 controls the tractor motor 84 actuating the tractor unit 6, a fixing motor 82 actuating the fixing unit 30, and a main motor 86 rotating the photoconductive drum 16.

The fixing unit 30 includes a heat roller 40 accommodating a heat source therein and a press roller 45 having a surface made of an elastic member. The heat roller 40 is rotationally driven by the fixing motor 82, and the press roller 45 is rotated so as to follow the heat roller 45. Further, in order to give tension to a portion of the recording sheet P between the fixing unit 30 and the tractor unit 6, when the recording sheet P is fed in a forward direction, the circumferential speed of the heat roller 40 is set to be slightly faster than the feeding speed of the recording sheet P by the tractor unit 6.

Further, the fixing unit 30 is provided with an opening/closing mechanism 33 for opening and closing the heat roller 40 and the press roller 45. The opening/closing mechanism 33 moves the press roller 45 between an operating position where the recording sheet P is pressed between the press roller 45 and the heat roller 40 and a retracted position where the press roller 45 is retracted from the operating position.

In the transfer unit 20, the corona charger 19 is supported by a swingable holder 22 swingably provided around a swing axis 21 so as to be movable between an operating position adjacent to the surface of the photoconductive drum 16 and a retracted position away from the 16. The swingable holder 22 is swung by a slide arm 23 which, linked with the opening/closing mechanism 33, slides to the right and to the left in the view of FIG. 1.

Further, a discharge roller unit 70 for discharging the recording sheet P is provided between the fixing unit 30 and the sheet outlet 12. The discharge roller portion 70 is formed of an upper roller 71 and a lower roller 72 disposed above and below the recording sheet P. The upper roller 71 is linked with the opening/closing mechanism 33 and moves between an operating position where the recording sheet is sandwiched between the upper roller 71 and the lower roller 72 and a retracted position where the upper roller 71 is retracted from the operating position.

The printer 1 is arranged to discharge a printed page of the recording sheet so that a user may check the printed page and to retract the recording sheet when the next printing is started. When the recording sheet is retracted or stopped, the press roller 45, the corona charger 19, and the upper roller 71 are moved to their retracted positions by the opening/closing mechanism 33, thereby to release the feeding path of the recording sheet.

Figure 2:
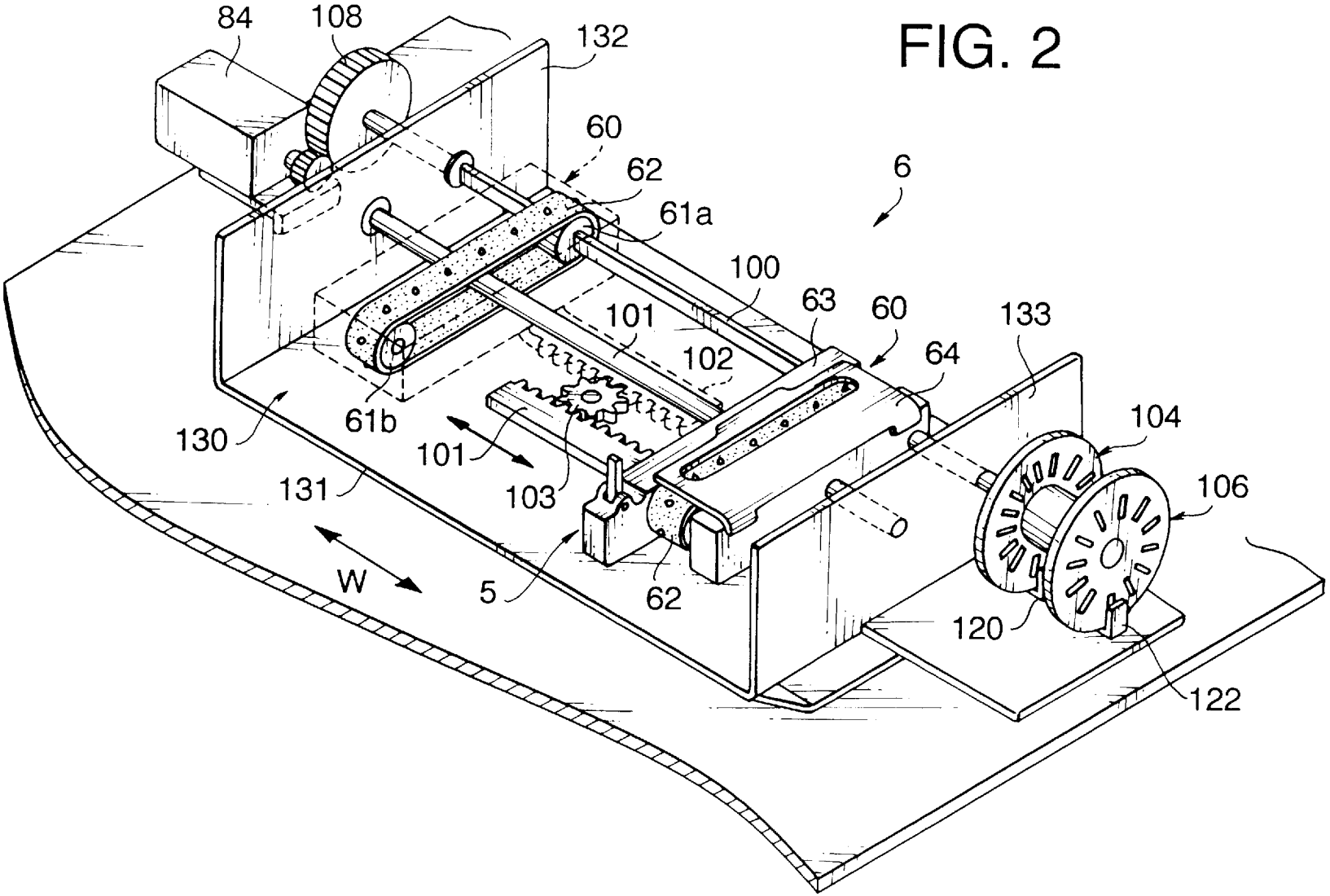
FIG. 2 is a perspective view of a tractor unit according to an embodiment of the invention.

The construction of the tractor unit 6 is now described. FIG. 2 is a perspective view of the tractor unit 6. The tractor unit 6 includes a U-shaped unit frame 130 and the two tractors 60. Each tractor 60. includes the tractor belt 62 having protrusions engaging with feed holes (not shown) formed on both sides of the recording sheet P and the pulleys 61*a* and 61*b* for driving the tractor belt 62.

The tractor belt 62 and the pulleys 61*a* and 61*b* are rotatably supported by a support frame 63. In FIG. 2, the support frame 63 on the left side is shown by dotted lines, in order to show the pulleys 61 and the tractor belt 62 accommodated therein.

In the embodiment, in order to feed recording sheets having various widths, both tractors 60 are movable in the width direction W of the recording sheet P. In order to movably support the tractors 60, a guide shaft 110 is provided across both side plates 132 and 133 of the unit frame 130. The support frames 53 are slidably supported by the guide shaft 110.

Further, in order to move both of the tractors 60 symmetrically with respect to the center of the width of the recording sheet P, racks 101 and 102 extending inwardly in the width direction W of the recording sheet are formed below the respective support frames 63. The racks 101 and 102 are linked via a pinion 103 provided substantially in the center of the tractors 60 such that, when one of the tractors 60 is moved and adjusted, the other tractor 60 is moved symmetrically.

A drive shaft 100 is provided for driving the pulleys 61*a* extending through the driving pulleys 61*a*. Ends of the drive shaft 100 extend outwardly at the left side plate 132 and at the right side plate 133, respectively. The drive shaft 100 is driven by the tractor motor 84 via a slave gear 108 provided at the left end of the drive shaft 100.

Encoders for outputting Pulse Feed Signals (PFSs) for feeding of the recording sheet P by a predetermined amount are provided at the right end of the drive shaft 100. In order to deal with recording sheets P having a plurality of page lengths, two encoders 104 and 106 are provided. Rotation of the encoders 104 and 106 is sensed by photo-sensors 120 and 122 provided below both encoders, respectively. The controller 80 (FIG. 1) selects one or both of the photo-sensors 120, 122 according. to the page length. selected on a control panel 8 to control the feeding of the recording sheet P based on pulse feed signals output from the photo-sensors 120, 122 concerned.

Figure 3:
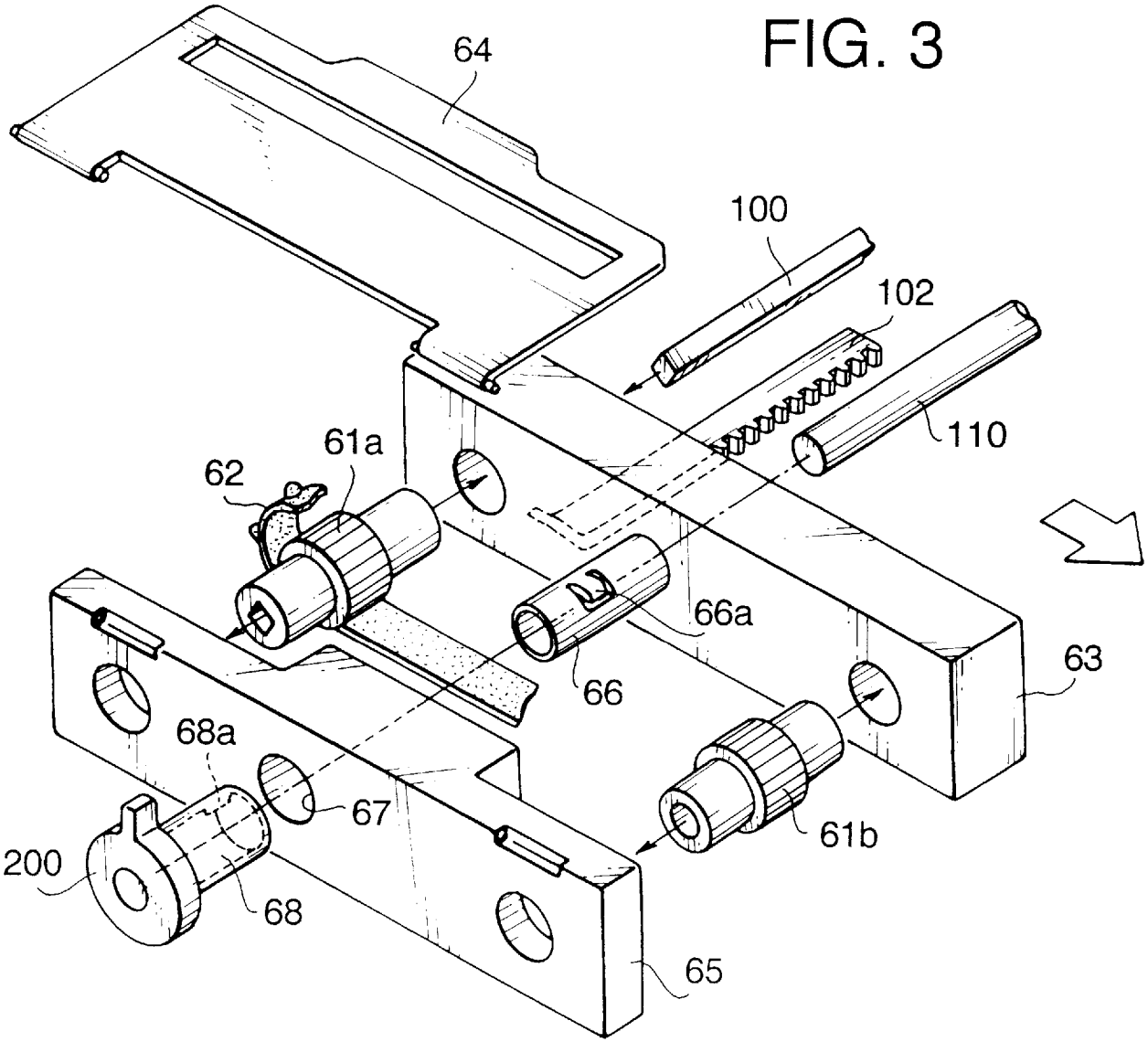
FIG. 3 is a perspective exploded view of a tractor frame on the left side of the tractor unit of FIG. 2.

The structure of the tractors 60 is now described. FIG. 3 is an enlarged perspective exploded view of the tractor 60 on the left side in FIG. 2. in FIG. 3, a large arrow shows the direction of feeding of the recording sheet A sub-frame 65 is provided to the support frame 63 so that the tractor belt 62 and the pulleys 61*a* and 61*b* are located between the sub-frame 65 and the support frame 63. A swinging cover 64 (cover member) is provided on the sub-frame 65, to cover the upper side of the tractor belt 62 thereby to maintain the engagement of the feed holes of the recording sheet P (not shown in FIG. 3) and the protrusions of the tractor belt 62. On setting the recording sheet P in the tractor 60, the swinging cover 64 is swung up to open the upper side of the tractor belt 62. Then, after the feed holes of the recording sheet P are fit to protrusions of the tractor belt 62, the swinging cover 64 is closed to hold the recording sheet to the tractor belt 62.

The arrangement for adjusting the distance between the tractors 60 is described. The support frame 63 is provided with a first cylindrical portion 66 through which the guide shaft 110 is inserted. The first cylindrical portion 66 is inserted through a through hole 67 formed in the sub-frame 65. A tab 200, provided to the sub-frame 65, has a second cylindrical portion 68 inserted through the through hole 67 in the sub-frame 65 from the outside (from the side opposite to the support frame 63). In the through hole 67, the second cylindrical portion 68 is positioned so as to surround the first cylindrical portion 66.

A notch 66*a* is formed on the first cylindrical portion 66 such that the end of the notch 66*a* slightly protrudes over the outer diameter of the first cylindrical portion 66. A protrusion 68*a* protruding inwardly is formed inside the second cylindrical portion 68. By rotating the tab 200, the protrusion 68*a* in the second cylindrical portion 68 is brought into contact with the notch 66*a* on the first cylindrical portion 66 to urge inwardly the notch 66*a*. Then, the notch 66*a* is brought into contact with the guide shaft 110 to urge the guide shaft 110, by which the tractor 60 is fixed with respect to the guide shaft 110. That is, by turning the tab 200 so that the protrusion 68*a* in the second cylindrical portion 68 moves apart from the notch 66*a* on the first cylindrical portion 66, the tractors 60 (support frames 63 and sub-frames 65) become slidable along the guide shaft 110.

As constructed above, the distance between the tractors 60 can be adjusted according to the width of the recording sheet by the following steps: (1) turning the tab 200 so as to release the engagement of the protrusion 68*a* and the notch 66*a*, (2) moving at least one of tractors 60 along the guide shaft 110 according to the width of the recording sheet, and (3) turning the tab 200 so that the protrusion 68*a* is brought into contact with the notch 66*a*.

Figure 4:
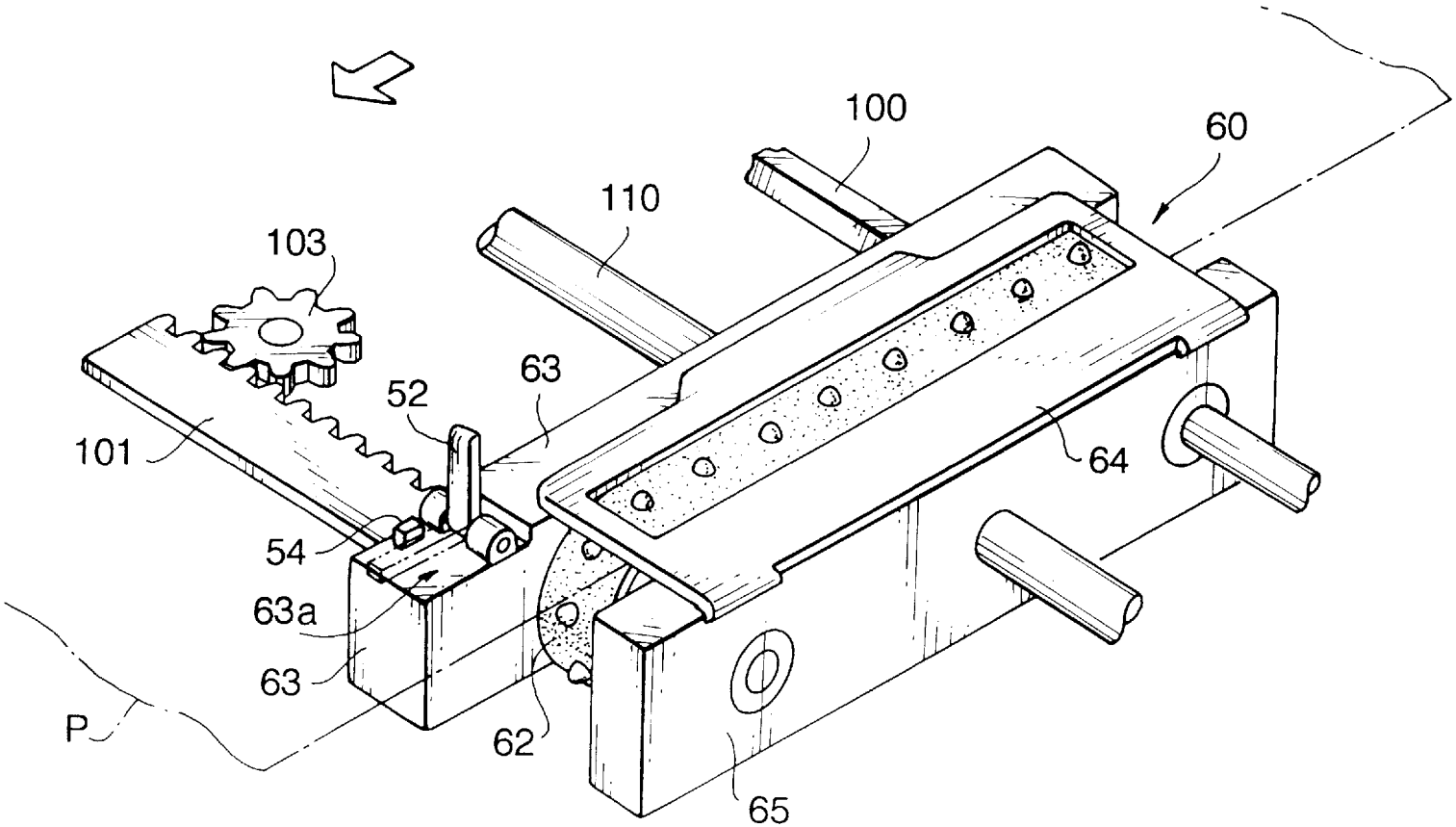
FIG. 4 is a perspective view of a tractor frame on the right side of the tractor unit shown in FIG. 2.

A top sensor 5 is now described. FIG. 4 is a perspective view of the tractor 60 on the right side in FIG. 2. In FIG. 4, a large arrow shows the direction of feeding of the recording sheet P. The tractor 60 on the right side is constructed substantially symmetrically with the tractor 60 on the left side (FIG. 3).

The top sensor 5 for sensing passage of a leading edge of the recording sheet P is provided on the support frame 63 and is located at the downstream side of the swinging cover 64 in the direction of feeding of the recording sheet P. The top sensor 5 includes a swinging lever 52 swingable between an erect position (shown by a solid line) and a retracted position (shown by a dotted line). When the swinging lever 52 is in the erect position, the swinging lever 52 projects across a feeding path of the recording sheet P. The swinging lever 52 is biased upward by a torsion spring (not shown). The top sensor 5 further includes a sensor 54 which detects the swinging lever 52 when the swinging lever 52 is in the retracted position. The sensor 54 generates an OFF signal when the swinging lever 52 is in the erect position and an ON signal when the swinging lever 52 is in the retracted position.

The top sensor 5 is provided to a step portion 63*a* of the support frame 63, which is made lower than the top surface of the support frame 63. Thus, the top sensor 5 is positioned beneath the sheet feeding path, so that top sensor 5 does not interfere with the passage of the recording sheet P, when the swinging lever 52 is in the retracted position.

Since the top sensor 5 is provided to the tractor 60 where the swinging cover 64 presses the recording sheet P from above, the swinging lever 52 will not be in the erect position even if the recording sheet P is warped. Thus, an incorrect determination of a leading edge of the recording sheet P is prevented. Particularly, since the top sensor 5 is located adjacent to and at the downstream side of the swinging cover 64, there is very little chance that there will be upward deformation of the recording sheet in the vicinity of the top sensor 5.

Further, even if the tractor 60 is moved to adjust the distance between the support frames 63 according to the width of the recording sheet P, the top sensor 5 is always in a position to detect the leading edge of the recording sheet P. Furthermore, since the top sensor 5 is integrally provided with the tractor 60, the number of parts for mounting the top sensor 5 is decreased.

Although the structure and operation of a tractor unit is described herein with respect to the preferred embodiments, many modifications and changes can be made without departing from the spirit and scope of the invention.

The present disclosure relates to subject matter contained in Japanese Patent Application No. HEI 08-219432 filed on Aug. 1, 1996 which is expressly incorporated herein by reference in its entirety.

What is claimed is:

1. A tractor unit for a recording sheet, said tractor unit comprising:

a pair of tractor belts, each tractor belt having protrusions engaging feed holes formed on a respective side of the recording sheet;

a pair of frames, each said frame positioned at an opposite side edge of the recording sheet and supporting a respective said tractor belt;

a top sensor provided on one of said pair of frames, said top sensor detecting passage of a leading edge of the recording sheet; and at least one cover member provided to said one of said pair of frames, said cover member holding the recording sheet to said tractor belt.

2. The tractor unit according to claim 1, wherein said top sensor is provided at a downstream side of said at least one cover member of said one of said pair of frames in a direction of feeding of the recording sheet.

3. The tractor unit according to claim 1, wherein each of said pair of frames is provided with said at least one cover member for holding the recording sheet to said tractor belt.

4. The tractor unit according to claim 1, further comprising two sets of pulleys which drive said pair of tractor belts, wherein said two sets of pulleys are supported by said pair of frames.

5. The tractor unit according to claim 1, wherein said top sensor comprises:

a swinging lever swingable between an erect position where said lever projects across a feeding path of the recording sheet, and a retracted position where said lever is retracted from said erect position, and a sensor detecting which position said swinging lever is in.

6. The tractor unit according to claim 1, wherein said frames are movable toward and away from each other so that the distance between two tractor belts can be adjusted.

7. The tractor unit according to claim 1, wherein said cover member is swingably provided on said frame.

8. A tractor unit for a recording sheet, said tractor unit comprising:

a pair of tractor belts, each said tractor belt positioned at an opposite side edge of the recording sheet and having protrusions engaging with feed holes formed on respective side edges of the recording sheet;

two sets of pulleys driving said pair of tractor belts, respectively;

a pair of frames, each said frame supporting one of said pair of tractor belts and one of said two sets of pulleys;

a pair of cover members provided to said pair of frames, each cover member holding the recording sheet to a respective said tractor belt; and a top sensor provided on one of said pair of frames and located downstream of said pair of cover members, said top sensor detecting passage of a leading edge of the recording sheet.

9. The tractor unit according to claim 8, wherein said top sensor comprises:

a swinging lever swingable between an erected position where said lever projects across a feeding path of the recording sheet, and a retracted position where said lever retracts from said erected position in which said lever falls down from said erected position, and a sensor detecting which position said swinging lever is in.

10. The tractor unit according to claim 8, wherein said frames are movable toward and away from each other so that the distance between tractor belts can be adjusted.

11. A tractor unit for a recording sheet, said tractor unit comprising:

at least one tractor member having protrusions engaging with feed holes formed on respective side edges of a recording sheet; and at least one frame positioned at one side edge of the recording sheet and which supports said tractor member;

at least one cover member provided to said at least one frame, said at least one cover member holding the recording sheet to said at least one tractor member; and a top sensor provided on said at least one frame, said top sensor detecting the passage of a leading edge of the recording sheet.

12. The tractor unit according to claim 11, wherein said at least one tractor member comprises a tractor belt.

13. The tractor unit according to claim 12, further comprising a set of pulleys for driving said at least one tractor belt.

14. The tractor unit according to claim 13, wherein said top sensor comprises:

a swinging lever swingable between an erected position where said lever projects across a feeding path of the recording sheet, and a retracted position where said lever retracts from said erected position; and a detecting sensor detecting which position said swinging lever is in.

* * * * *

UNITED STATES PATENT AND TRADEMARK OFFICE

CERTIFICATE OF CORRECTION

PATENT NO. : 5,847,747

DATED : December 8, 1998

INVENTOR(S) : Y. ISHIKAWA

It is certified that error appears in the above-identified patent and that said Letters Patent is hereby corrected as shown below:

At column 7, line 9 (claim 6, line 3) of the printed patent, after "between" delete the word —two—.

Signed and Sealed this

Twenty-sixth Day of December, 2000

*Attest:*

Q. TODD DICKINSON

*Attesting Officer*

*Director of Patents and Trademarks*